United States Patent [19]

Acton

[11] 4,322,103

[45] Mar. 30, 1982

[54] DOOR HOLDING DEVICE

[76] Inventor: Terry R. Acton, 3037 Newark, Lapeer, Mich. 48446

[21] Appl. No.: 149,259

[22] Filed: May 12, 1980

[51] Int. Cl.[3] ..... E05C 17/54

[52] U.S. Cl. ..... 292/288; 292/262

[58] Field of Search ..... 292/262, 258, 288, 339, 292/244

[56] References Cited

U.S. PATENT DOCUMENTS

| | | | |
|---|---|---|---|
| 2,523,088 | 9/1950 | Beyer | 16/86 |
| 2,618,497 | 11/1952 | Gardels | 292/288 X |
| 2,646,302 | 7/1953 | Viola | 292/340 |
| 2,825,594 | 3/1958 | Hatchette, Sr. | 292/95 |
| 2,967,595 | 1/1961 | Zitomer | 189/72 |
| 3,135,543 | 6/1964 | Engolls | 292/262 |
| 3,199,206 | 8/1965 | Snapp | 33/194 |
| 3,591,225 | 2/1970 | Hagemeyer | 292/340 |
| 3,655,228 | 4/1972 | Coopersmith et al. | 292/79 |
| 3,907,344 | 9/1975 | Newton et al. | 292/244 X |
| 3,908,976 | 9/1975 | Petrinec | 269/40 |
| 3,961,504 | 6/1976 | Sprecher | 292/DIG. 43 |
| 4,070,050 | 1/1978 | Glock et al. | 292/339 |

FOREIGN PATENT DOCUMENTS

| | | | |
|---|---|---|---|
| 8150 | of 1906 | United Kingdom | 4/102 |

*Primary Examiner*—Richard E. Moore

*Attorney, Agent, or Firm*—Gifford, VanOphem, Sheridan & Sprinkle

[57] ABSTRACT

A device is provided for use with a vehicle having a body and a door movable between an open and a closed position for rigidly but detachably holding the door in a predetermined open position. The vehicle door is of a conventional construction having a latch mechanism in the door which engages a cylindrical striker pin secured to the vehicle body when the door is in its closed position. The device comprises an elongated rod having a striker pin secured to and extending laterally outwardly from one end of the rod. A pair of elongated tabs are secured to the other end of the rod so that the tabs extend perpendicularly outwardly from the rod with respect to the axis of the rod. In addition, the tabs are spaced apart from each other by an amount sufficient to receive the vehicle striker pin therebetween. In the use of the device, the striker pin on one end of the rod is inserted into the latch mechanism of the door while the vehicle striker pin is positioned in between the locking tabs at the other end of the rod. In this fashion, the rod maintains the door in an open position by an amount corresponding to the length of the rod.

5 Claims, 3 Drawing Figures

DOOR HOLDING DEVICE

BACKGROUND OF THE INVENTION

I. Field of the Invention

The present invention relates to a device for rigidly but detachably holding a vehicle door at a predetermined open position.

II. Description of the Prior Art

Motor vehicles, such as automobiles, trucks, vans and the like, typically include a body having two or more passenger doors pivotally mounted at one end to the vehicle body by hinges so that the doors pivot about a substantially vertical axis. At the other end of the door a latch mechanism is provided which lockingly engages a cylindrical striker pin rigidly secured to the vehicle body when the door is in its closed position. The latch mechanism, however, can be manually released to permit the door to be opened by a door handle either within or outside the vehicle.

Many instances arise in vehicle workshops, such as bump and coolision shops, rustproofing shops and the like in which it is desirable or even necessary to rigidly maintain the vehicle door in an open position. For example, it is desirable to rigidly maintain the door in an open position when repairing or bumping dents on the door itself. Similarly, in rustproofing automotive shops small holes must be drilled through the door, usually from the bottom of the door, in order to insert the tools for spraying the rustproofing material. Unless the door is rigidly maintained in an open position while these holes are drilled, the drill can slip and strike against unintended parts of the vehicle. This, in turn, can damage the drill or even the motor vehicle itself.

In order to rigidly maintain the door in an open position, it has been the previous practice for workmen in vehicle workshops to jam blocks of wood in between the vehicle body and the vehicle door at or near its pivotally connected end in order to hold the door in an open position. This procedure, however, is unsatisfactory in a number of different respects. First, since the vehicle doors and bodies vary between different types and different brands of vehicles, it is necessary for the workmen to select an appropriate block of wood to jam the door open by a trial and error method. This, of course, is a time consuming and therefore expensive task. Moreover, in some cases an appropriate block of wood which will adequately jam the door open cannot be found and must be specially cut by the workmen.

A still further disadvantage of jamming the vehicle door open with a wood block, even when the wood block is properly selected, is that the wood block is incapable of rigidly maintaining the vehicle door in a fixed position when an excessive force is applied to the door. This occurs since the wood is softer than the metal vehicle body and door. Thus, the force imparted to the door, such as by a hammer in bumping a dent from the door, is undesirably imparted to the wood rather than to the dent in the door.

SUMMARY OF THE PRESENT INVENTION

The present invention overcomes all of the above mentioned disadvantages of jamming a vehicle door open with wood blocks by providing a device for rigidly maintaining a vehicle door in an open position and which can be simply and rapidly attache dto the vehicle and its door.

In brief, the device according to the present invention comprises an elongated rod which is preferably constructed of a strong metal. A striker pin is secured to one end of the rod which conforms in shape and size to the vehicle striker pin. Moreover, such striker pins are used in only a very limited different number of sizes so that a single striker pin is able to accommodate a wide variety of different types of motor vehicles.

A pair of elongated tabs are secured to the other end of the rod so that the tabs extend perpendicularly laterally outwardly from both sides of the rod. In addition, the elongated tabs are spaced apart from each other by an amount sufficient to fit over and receive the vehicle striker pin therebetween.

In the use of the device according to the present invention, the striker pin at the end of the rod is first inserted into the latch mechanism of the vehicle door so that the mechanism lockingly engages one end of the rod via the striker pin. The other end of the rod is then positioned so that the vehicle striker pin is received between the two locking pads thereby maintaining the door in an open position by an amount corresponding to the longitudinal length of the rod. Moreover, since the elongated tabs extend laterally outwardly from two sides of the rod, the device can be used for either the left or right door of the motor vehicle.

The device according to the present invention is of a simple and inexpensive construction and can be rapidly installed in and removed from the motor vehicle as required. Moreover, since the device is preferably constructed of metal and in operation is installed between the vehicle door and the vehicle body at the end of the door opposite from its pivotal connection, the device rigidly maintains the vehicle door in its open position.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
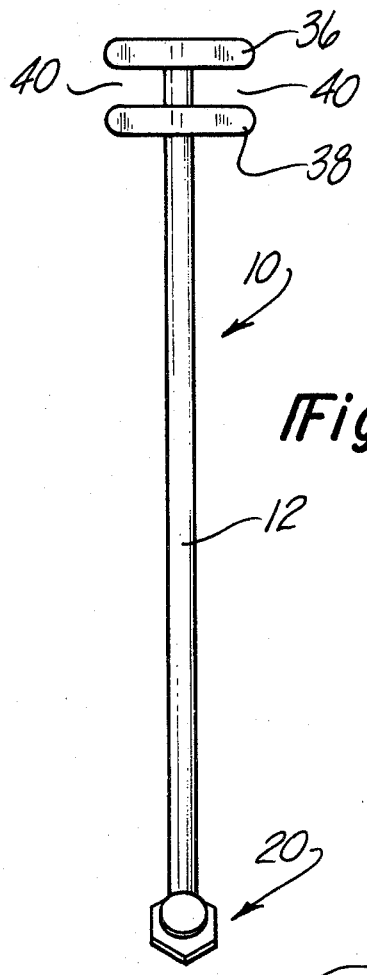
FIG. 1 is a front view illustrating the device according to the present invention.
Figure 2:
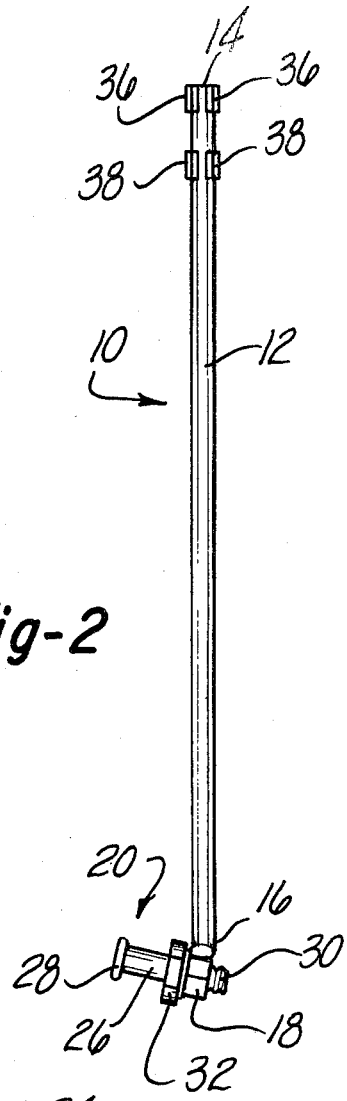
FIG. 2 is a side view illustrating the device according to the present invention.

With reference first to FIGS. 1 and 2, the device 10 according to the present invention is thereshown and comprises an elongated member or rod 12 having a first end 14 and a second end 16. The rod 12 is preferably constructed of a lightweight metal, such as aluminum, and can be of any desired cross-sectional shape. A nut 18 is secured to the end 16 of the rod 12 by any conventional method, such as welding.

A striker pin 20 of the type which is lockingly but releasably received within a latch mechanism 22 (FIG. 3) on the side 50 of a vehicle door 24 is secured to the lower end 16 of the rod 12. The striker spin 20 includes a cylindrical body portion 26 having an enlarged diameter portion 28 at its free end and a threaded shank 30 at its other end. The threaded shank 30 threadably engages the nut 18. To facilitate the attachment and/or detachment of the striker pin 20 with the nut 18, the striker pin 20 includes a hexagonal portion 32 at one end of the threaded shank 30 so that a wrench can be used to tighten the striker pin 20 into the nut 18.

Still referring to FIGS. 1 and 2, the striker pin 20 protrudes laterally outwardly from the rod 12 and is angled slightly towards the other end 14 of the rod 12 for a reason hereinafter described.

A pair of elongated locking tabs 36 and 38 are secured to the other end 14 of the rod 12 on one side thereof while, similarly, a further pair of locking tabs 36 and 38 are secured to the other side of the rod 12. The locking tabs 36 bare spaced and parallel with each other while, similarly, the locking tabs 38 are spaced and parallel with respect to each other. The locking tabs 36 and 38 both extend perpendicularly across the rod 12 and so that a portion of each locking tab 36 and 38 extends outwardly from each lateral side of the rod 12 as is best shown in FIG. 1. Moreover, as is best shown in FIG. 2, the plane of the locking tabs 36 and 38 is substantially perpendicular to the axis of the striker pin 20.

The locking tabs 36 and 38, moreover, are spaced apart and generally parallel with each other thus forming a U-shaped channel 40 on each lateral side of the rod 12. Furthermore, the locking tabs 36 and 38 are spaced apart from each other by an amount at least as great as the diameter of a striker pin 42 (FIG. 3) which is secured to the vehicle body 44. Thus, the locking tabs 36 and 38 define a generally U-shaped channel 40 on opposite sides of the rod 12 dimensioned to receive the vehicle striker pin 42 therein, Alternatively, the rod 12 and the elongated tabs 36 and 38 can be formed as a single stamping. In this event, only a single elongated tab 36 and a single elongated tab 38 may be secured to or formed at the end 14 of the rod 12.

Figure 3:
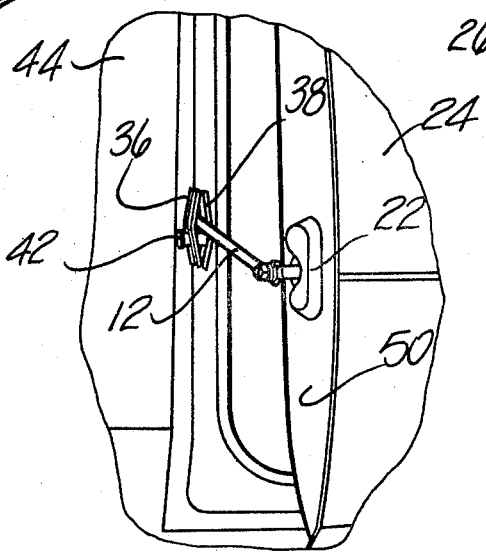
FIG. 3 is a perspective view illustrating the device of the present invention installed in a vehicle.

With reference now to FIG. 3, the operation of the device 10 is thereshown for use with a vehicle having a body 44 and the door 24 which is pivotally secured at one end (not shown) to the vehicle body 44. At the other end of the door 24 the latch mechanism 22 is carried in the door 24 and cooperates with the vehicle striker pin 42 secured to the vehicle body 44.

The device striker pin 20 is first inserted into the latch mechanism 22 for the door 24 so that the latch mechanism 22 lockingly, but releasably, engages the device striker pin 20. Since the striker pin 20 is cylindrical in shape, the rod 12 can pivot about the axis of the striker pin 20.

The locking tabs 36 and 38 then engage the vehicle striker pin 42 by pivoting the rod 12 over and on top of the vehicle striker pin 42 so that it is received within one of the U-shaped channels 40 between the locking tabs 36 and 38. In this fashion, the engagement between the latched mechanism 22 and the striker pin 20 locks the end 16 of the rod 12 to the vehicle door 24 while, similarly, the locking tabs 36 and 38 lock the opposite end 14 of the rod 12 to the vehicle striker pin 42 thus locking the vehicle door 24 in an open position corresponding to the longitudinal length of the rod 12. The weight of the device 10 maintains the locking engagement between the end 14 of the rod 12 and the vehicle striker pin 42. The outwardly protrusion of the locking tabs 36 and 38 from both sides of the rod 12 also enables the device 10 to be used for either the left or right vehicle doors.

The door latch mechanism 22 is designed to receive the vehicle striker pin 42 in a preoriented axial position. Thus, the angle of the device striker pin 20 toward the upper end 14 of the rod 12 is designed to compensate for the angular displacement of the latch mechanism caused by opening the door by the predetermined amount corresponding to the length of the rod.

From the foregoing it can be seen that the device 10 according to the present invention provides a simple, inexpensive and yet totally effective means for maintaining a vehicle door in an opened position in order to perform a work operation on the door. Moreover, since the device 10 is preferably constructed of metal, it rigidly locks the door 24 against movement relative to the vehicle body and can be simply installed and removed from the vehicle as desired.

Having described my invention, however, many modifications thereto will become apparent to those skilled in the art to which it pertains without deviation from the spirit of the invention as defined by the scope of the appended claims.

I claim:

1. For use with a vehicle having a body and a door pivotal around a substantially vertical axis and movable between an open and a closed position with respect to the body, either said door or said body having a latch mechanism and the other of said door or said body having a lock element, wherein the latch mechanism releasably lockingly engages the lock element on the other of said door or said body when said door is in its closed position, a device for holding the door in a predetermined open position comprising:

an elongated member;

first means secured to one end of the elongated member for releasably lockingly engaging the latch mechanism;

second means secured to the other end of the elongated member for releasably lockingly engaging the lock element; and wherein the lock element comprises a cylindrical striker pin and wherein said first means comprises a cylindrical pin substantially identical to said lock element wherein said second means comprises a pair of elongated tabs extending laterally outwardly from at least one side of said elongated member, said tabs being spaced apart by an amount sufficient to receive the striker pin therebetween; and wherein with said first means attached to said latch mechanism, said elongated member extends substantially horizontally so that the weight of the device maintains the locking engagement between said second means and the lock element.

2. The invention as defined in claim 1 wherein the axis of the cylindrical pin is oblique with respect to the axis of the elongated member whereby upon insertion of the cylindrical pin into said latch mechanism, said elongated member can pivot about the axis of the cylindrical pin.

3. For use with a vehicle having a left and right side, a body and at least one door movable between an open and a closed position with respect to the body, said door being on either the right or left side of the body, either said door or said body having a latch mechanism and the other of said door or said body having a lock element, wherein said latch mechanism releasably lockingly engages the lock element on the other of said door or said body when said door is in its closed position, a device for holding the door in a predetermined open position comprising:

an elongated member;

first means secured to one end of the elongated member for releasably lockingly engaging the latch mechanism on either side of said vehicle second means secured to the other end of the elongated member for releasably lockingly engaging the lock element on either side of the vehicle; and wherein the lock element comprises an elongated striker pin and wherein said second means further comprises a pair of elongated tabs extending laterally outwardly from at least one lateral side of said elongated member, said tabs being spaced apart by an amount sufficient to receive the striker pin therebetween.

4. The invention as defined in claim 3 wherein said tabs extend laterally outwardly from both sides of the elongated member.

5. The invention as defined in claim 3 wherein said first means comprises a cylindrical pin extending laterally outwardly from said rod whereby upon insertion of said cylindrical pin into said latch mechanism, said elongated member can pivot about the axis of said pin and wherein the longitudinal axis of the tabs are substantially tangential to an arc circumscribed by the pivotal action of said elongated member.

* * * * *

UNITED STATES PATENT AND TRADEMARK OFFICE

CERTIFICATE OF CORRECTION

PATENT NO. : 4,322,103

DATED : March 30, 1982

INVENTOR(S) : Terry Acton

It is certified that error appears in the above—identified patent and that said Letters Patent is hereby corrected as shown below:

Column 1, line 23, delete "coolision" and insert thereinstead --collision--;
line 67, delete "attache dto" and insert thereinstead --attached to--.

Column 2, line 18, insert --latch-- between "the" and "mechanism".

Signed and Sealed this

Sixth Day of July 1982

[SEAL]

*Attest:*

GERALD J. MOSSINGHOFF

*Attesting Officer*

*Commissioner of Patents and Trademarks*